US008191627B2

(12) United States Patent
Hamid et al.

(10) Patent No.: US 8,191,627 B2
(45) Date of Patent: Jun. 5, 2012

(54) TUBULAR EMBEDDED NOZZLE ASSEMBLY FOR CONTROLLING THE FLOW RATE OF FLUIDS DOWNHOLE

(75) Inventors: Syed Hamid, Dallas, TX (US); Michael Linley Fripp, Carrollton, TX (US); Edward John Patton, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 248 days.

(21) Appl. No.: 12/750,476

(22) Filed: Mar. 30, 2010

(65) Prior Publication Data

US 2011/0240284 A1 Oct. 6, 2011

(51) Int. Cl.
*E21B 21/00* (2006.01)

(52) U.S. Cl. ..... 166/222; 166/316; 166/169

(58) Field of Classification Search ..... 166/169, 166/316, 222, 305.1, 371
See application file for complete search history.

(56) References Cited

U.S. PATENT DOCUMENTS 4,364,232 A 12/1982 Sheinbaum
4,648,455 A * 3/1987 Luke ..... 166/303
5,338,496 A 8/1994 Talbot et al.
5,464,059 A * 11/1995 Kristiansen ..... 166/269
5,707,214 A * 1/1998 Schmidt ..... 417/109
6,708,763 B2 * 3/2004 Howard et al. ..... 166/303
6,769,498 B2 8/2004 Hughes
7,350,577 B2 4/2008 Howard et al.
7,464,609 B2 12/2008 Fallet
7,686,078 B2 * 3/2010 Khomynets ..... 166/254.2
2003/0173086 A1 9/2003 Howard et al.
2004/0011561 A1 1/2004 Hughes
2005/0150657 A1 7/2005 Howard et al.
2007/0193752 A1 8/2007 Kim
2008/0251255 A1 * 10/2008 Forbes et al. ..... 166/305.1
2008/0314578 A1 12/2008 Jackson

* cited by examiner

*Primary Examiner* — Nicole Coy
(74) *Attorney, Agent, or Firm* — Lawrence R. Youst

(57) ABSTRACT

An apparatus (100) for controlling the flow rate of a fluid during downhole operations. The apparatus (100) includes a tubular member (134) having a flow path (136) between inner and outer portions of the tubular member (134). The flow path (136) includes an inlet (138) in an inner sidewall (140) and an outlet (142) in an outer sidewall (144) of the tubular member (134). The inlet (138) and the outlet (142) are laterally offset from each other. A fluidic device (146) is positioned in the flow path (136) between the inlet (138) and the outlet (142). The fluidic device (146) is embedded within the tubular member (134) between the inner sidewall (140) and the outer sidewall (144). The fluidic device (146) includes a nozzle (154) having a throat portion (156) and a diffuser portion (158) such that fluid will flow through the nozzle (154) at a critical flow rate.

17 Claims, 9 Drawing Sheets

TUBULAR EMBEDDED NOZZLE ASSEMBLY FOR CONTROLLING THE FLOW RATE OF FLUIDS DOWNHOLE

FIELD OF THE INVENTION

This invention relates, in general, to equipment utilized in conjunction with operations performed in subterranean wells and, in particular, to a tubular embedded nozzle assembly for controlling the inflow or injection rate of fluids in a downhole environment.

BACKGROUND OF THE INVENTION

Without limiting the scope of the present invention, its background is described with reference to steam injection, as an example.

It is common practice in the production of hydrocarbons from a reservoir to use a variety of techniques to maximize recovery. Typically, in the initial stage of hydrocarbon production from a reservoir, energy stored in the reservoir displaces the hydrocarbon fluids from the reservoir into the wellbore and up to surface. Whether gasdrive, waterdrive, gravity drainage or the like, the reservoir pressure is sufficiently higher than the bottomhole pressure inside the wellbore such that the natural pressure difference drives the hydrocarbon fluids toward the well and up to surface. It has been found, however, that reservoir pressure declines as a result of hydrocarbon production. This decline in reservoir pressure results in a reduced differential pressure between the bottomhole pressure and the reservoir pressure which in turn causes production rates to decline.

In certain reservoirs, production rates can be maintained at economic levels using secondary recovery techniques that stabilize reservoir pressure, displace hydrocarbons toward the wellbore or both. For example, secondary recovery may involve injecting a fluid, such as water or gas, into the reservoir from one or more injection wells that are in fluid communication with the production wells. Specifically, gas may be injected into the gas cap to enhance reservoir pressure and/or water may be injected into the production zone to displace oil from the reservoir. Once secondary recovery techniques reach the end of their economic viability, the productive life of certain reservoirs may be further extended using enhanced oil recovery techniques. For example, enhanced oil recovery operations may involve chemical flooding, miscible displacement and thermal recovery.

One method of thermal recovery involves the use of steam which may be generated at surface and injected into the reservoir through one or more injection wells. In this operation, the steam enters the reservoir and heats up the crude oil to reduce its viscosity. In addition, the hot water that condenses from the steam helps to drive oil toward producing wells. It has been found, however, that steam regulation may be difficult, particularly when the steam is being injected into multiple zones of interest from a single injection well. In this scenario, the annular area between the tubular and each zone of interest is typically isolated with packers. Steam is injected from the tubular into each zone of interest through one or more nozzles located in the tubing string at each zone. Due to differences in the pressure and/or permeability of the zones as well as pressure and thermal losses in the tubular string, the amount of steam entering each zone is difficult to control. One way to assure steam injection at each zone is to establish a critical flow regime through each of the nozzles.

Critical flow of a compressible fluid through a nozzle is achieved when the velocity through the throat of the nozzle is equal to the sound speed of the fluid at local fluid conditions. Once sonic velocity is reached, the velocity and therefore the flow rate of the fluid through the nozzle cannot increase regardless of changes in downstream conditions. Accordingly, regardless of the differences in annular pressure at each zone, as long as critical flow is maintained at each nozzle, the amount of steam entering each zone is known. It has been found, however, that to ensure the critical flow of steam through typical steam injection nozzles, the annulus to tubing pressure ratio must be maintained below about 0.6. To overcome this limitation, attempts have been made to use nozzles having downstream diffuser portions to increase the annulus to tubing pressure ratio that can maintain critical flow. These installations, however, have involved the use of tubular strings having side pockets which significantly increase tubing complexity and reduce fluid flow capacity.

Therefore, a need has arisen for an apparatus and method for extending the productive life of a reservoir by improving steam injection recovery techniques. A need has also arisen for such an apparatus and method that is operable to maintain critical flow of steam into a zone of interest at annulus to tubing pressure ratios over 0.56. Further, a need has arisen for such an apparatus and method that is operable to inject steam at a controlled flow rate into multiple zones of interest from a single injection wellbore.

SUMMARY OF THE INVENTION

The present invention disclosed herein is directed to an improved apparatus and method for extending the productive life of a reservoir by enhancing steam injection recovery techniques. The apparatus and method of the present invention are operable to maintain critical flow of steam into a zone of interest at annulus to tubing pressure ratios over 0.56. In addition, the apparatus and method of the present invention are operable to inject steam at a controlled flow rate into multiple zones of interest from a single injection wellbore.

In one aspect, the present invention is directed to an apparatus for controlling the flow rate of a fluid during downhole operations. The apparatus includes a tubular member having a flow path between inner and outer portions of the tubular member. The flow path includes a generally radial inlet and a generally radial outlet that are laterally offset from each other. A fluidic device is positioned in the flow path between the inlet and the outlet. The fluidic device is embedded within the tubular member between inner and outer sidewalls of the tubular member, whereby the fluidic device is operable to control the flow rate of the fluid through the flow path.

In one embodiment, the inlet is in the inner sidewall of the tubular member and the outlet is in the outer sidewall of the tubular member. In another embodiment, the inlet is in the outer sidewall of the tubular member and the outlet is in the inner sidewall of the tubular member. In one embodiment, the inlet and the outlet are laterally offset from each other in the axial direction of the tubular member. In another embodiment, the inlet and the outlet are laterally offset from each other in the circumferential direction of the tubular member. In one embodiment, the fluidic device is formed from a plate member that is positioned between the inner sidewall and the outer sidewall of the tubular member. In another embodiment, the fluidic device is formed from a curved plate member that is positioned between the inner sidewall and the outer sidewall of the tubular member.

In one embodiment, the fluidic device includes a nozzle having a throat portion and a diffuser portion, whereby the fluid will flow through the nozzle at a critical flow rate. In another embodiment, the fluidic device is a two stage fluidic device wherein one of the stages includes a nozzle having a throat portion and a diffuser portion, whereby the fluid will flow through the nozzle at a critical flow rate. In a further embodiment, the flow path includes first and second inlets, the fluidic device includes a pair of nozzles each having a throat portion and a diffuser portion, whereby the fluid will flow through the nozzles at a critical flow rate and the nozzles share the outlet.

In another aspect, the present invention is directed to an apparatus for controlling the flow rate of fluid injected into a downhole formation. The apparatus includes a tubular member having a flow path between inner and outer portions of the tubular member. The flow path includes an inlet in an inner sidewall of the tubular member and an outlet in an outer sidewall of the tubular member. The inlet and the outlet are laterally offset from each other. A fluidic device is positioned in the flow path between the inlet and the outlet. The fluidic device is embedded within the tubular member between the inner sidewall and the outer sidewall. The fluidic device includes a nozzle having a throat portion and a diffuser portion, whereby the fluid will flow through the nozzle at a critical flow rate.

In one embodiment, the apparatus may include a latching assembly that is coupled to the tubular member. The latching assembly is operable to establish a secure relationship between the apparatus and a downhole tubular string into which the apparatus is inserted. Alternatively or additionally, the apparatus may include a pair of packing assemblies positioned on opposite sides of the tubular member. The packing assemblies are operable to establish a sealing relationship between the apparatus and a downhole tubular string into which the apparatus is inserted. The packing assemblies provide isolation such that fluid discharged from the outlet is in fluid communication with at least one opening of the downhole tubular string.

In another aspect, the present invention is directed to a flow control apparatus for controlling the inflow of production fluids from a subterranean well. The flow control apparatus includes a tubular member having a flow path between outer and inner portions of the tubular member. The flow path includes an inlet in an outer sidewall of the tubular member and an outlet in an inner sidewall of the tubular member. The inlet and the outlet are laterally offset from each other. A fluidic device is positioned in the flow path between the inlet and the outlet. The fluidic device is embedded within the tubular member between the inner sidewall and the outer sidewall. The fluidic device includes a nozzle having a throat portion and a diffuser portion, whereby the production fluids will flow through the nozzle at a critical flow rate.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
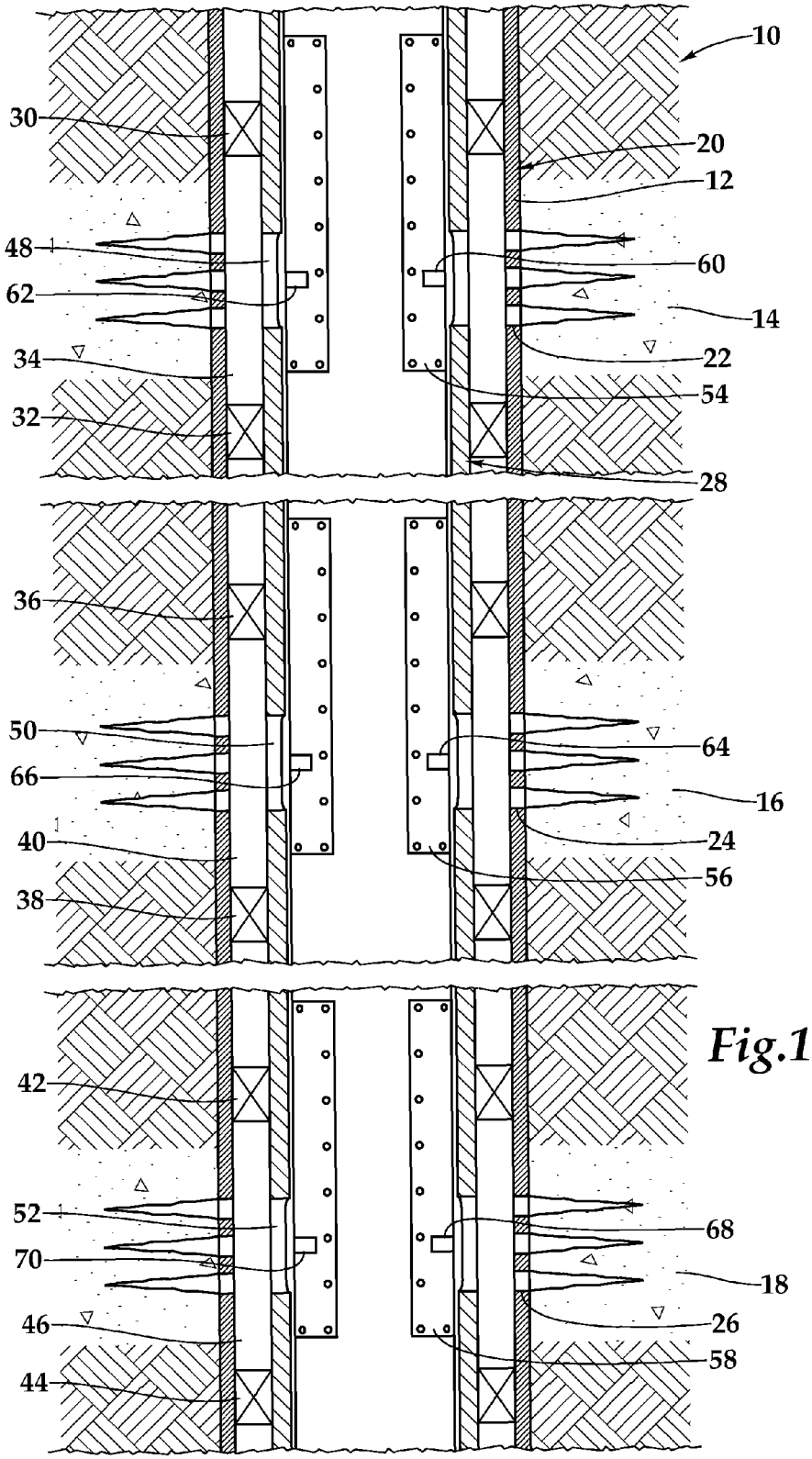
FIG. 1 is a schematic illustration of a well system including a plurality of apparatuses for controlling the flow rate of a fluid during downhole operations according to an embodiment of the present invention.

Referring initially to FIG. 1, a well system including a plurality of apparatuses for controlling the flow rate of a fluid during downhole operations positioned in a downhole tubular string is schematically illustrated and generally designated 10. A wellbore 12 extends through the various earth strata including formations 14, 16, 18. Wellbore 12 includes casing 20 that may be cemented within wellbore 12. Casing 20 is perforated at each zone of interest corresponding to formations 14, 16, 18 at perforations 22, 24, 26. Disposed with casing 20 and forming a generally annular area therewith is a tubing string 28 that includes a plurality of tools such as packers 30, 32 that isolate zone 34, packers 36, 38 that isolate zone 40 and packers 42, 44 that isolate zone 46. Tubing string 28 also includes a plurality of ported assemblies 48, 50, 52.

Positioned within tubing string 28 proximate each of the ported assemblies 48, 50, 52 is an apparatus 54, 56, 58 for controlling the flow rate of a fluid during downhole operations. In the illustrated embodiment, each apparatus 54, 56, 58 has two communication ports, namely communication ports 60, 62 of apparatus 54, communication ports 64, 66 of apparatus 56 and communication ports 68, 70 of apparatus 58. As explained in greater detail below, the communication ports of each apparatus form a portion of a flow path between the inside and outside of the apparatus. Each flow path includes a fluidic device that is embedded within sidewall of the apparatus and is operable to control the flow rate of a fluid traveling through the flow path. As illustrated, each apparatus 54, 56, 58 is in fluid communication with an isolated zone 34, 40, 46 and a corresponding formation 14, 16, 18.

In this configuration, each apparatus 54, 56, 58 may be used to control the injection rate of a fluid into its corresponding formation 14, 16, 18 when the illustrated communication ports 60, 62, 64, 66, 68, 70 act as outlets. For example, in a steam injection operation, each apparatus 54, 56, 58 is intended to deliver steam from the surface of the well to it corresponding formation 14, 16, 18 in a predetermined amount that is based upon the supply pressure at the surface and the characteristics of the embedded fluidic devices. Use of apparatuses 54, 56, 58 enables a controlled distribution of the steam into the various formations 14, 16, 18 at a constant mass flow rate, which is described in greater detail below. Alternatively, each apparatus 54, 56, 58 may be used to control the production rate of a fluid from its corresponding formation 14, 16, 18 when the illustrated communication ports 60, 62, 64, 66, 68, act as inlets. As another alternative, each apparatus 54, 56, 58 may be used to control the injection rate and the production rate of a fluid to and from its corresponding formation 14, 16, 18 when some of the illustrated communication ports act as inlets and other of the illustrated communication ports act as outlets. For example, communication ports 60, 64 and 68 may act as outlets while communication ports 62, 66 and 70 may act as inlets. These and various other configuration of the present invention will be discussed in detail below.

Even though FIG. 1 depicts the apparatuses for controlling the flow rate of a fluid during downhole operations of the present invention in a vertical section of the wellbore, it should be understood by those skilled in the art that the apparatuses of the present invention are equally well suited for use in wells having other configurations including slanted wells, deviated wells, horizontal well or wells having lateral branches. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. In addition, even though FIG. 1 depicts a well system with a particular number of zones, it should be understood by those skilled in the art that the apparatuses for controlling the flow rate of a fluid during downhole operations of the present invention are equally well suited for use in well having a greater number or lesser number of zones. Also, even though FIG. 1 depicts apparatuses having a particular number of communication ports associated with each zone, it should be understood by those skilled in the art that the apparatuses for controlling the flow rate of a fluid during downhole operations of the present invention may have any number of communication ports associated with each zone including having different numbers of communication ports associated with different zones.

Figure 2:
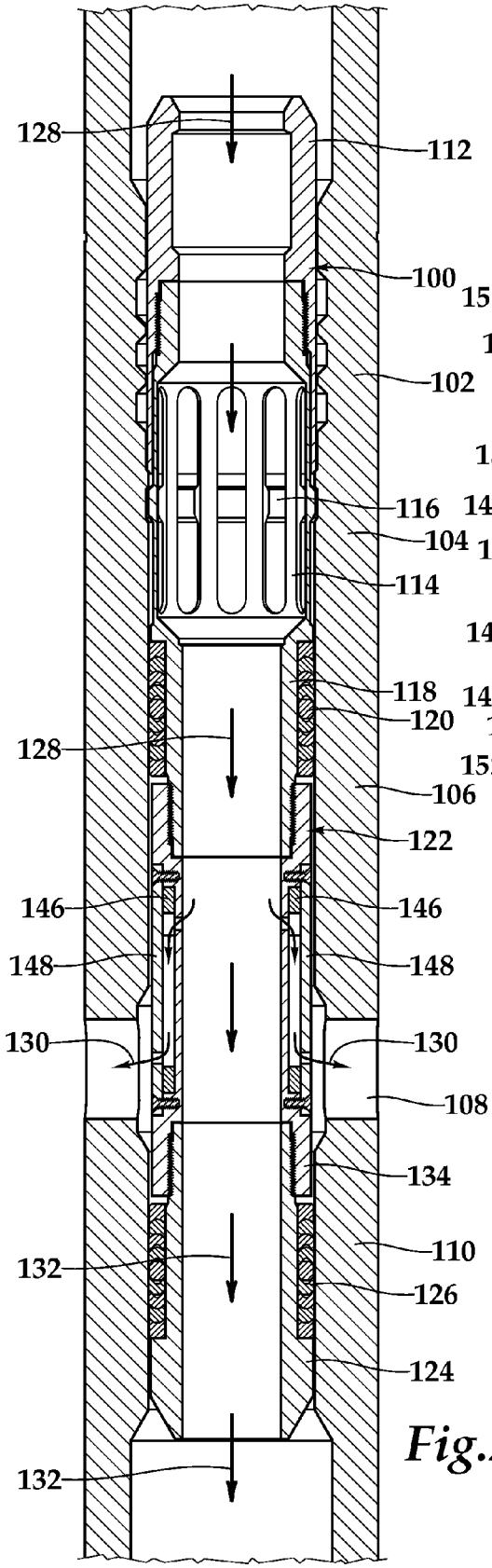
FIG. 2 is a cross sectional view of a well system including an apparatus for controlling the flow rate of a fluid during downhole operations according to an embodiment of the present invention.

Referring next to FIG. 2, therein is depicted an apparatus for controlling the flow rate of a fluid during downhole operations of the present invention positioned within a tubular string and generally designated 100. In the illustrated section, tubular string 102 includes a nipple assembly 104, a polished bore receptacle 106, a ported assembly 108 and a polished bore receptacle 110 each of which is designed to interact with apparatus 100. Apparatus 100 includes an upper connector 112, a latch assembly 114 including a plurality of collets fingers 116, a packing assembly 118 including packing stack 120, a flow control assembly 122 and a packing assembly 124 including packing stack 126.

In operation, apparatus 100 may be run into the wellbore on a conveyance such as a wireline, slickline, coiled tubing or the like that is coupled to upper connector 112. As apparatus 100 is conveyed into tubing string 102, apparatus 100 is received at the proper location based upon interaction between a corresponding nipple assembly 104 and latch assembly 114. This interaction allows certain apparatuses 100 to pass through certain nipple assemblies 104 without latching such that multiple apparatuses 100 may be installed in a well, as seen in FIG. 1. When received in the desired nipple assembly 104, latch assembly 114 secures apparatus 100 within tubular string 102. In this position, packing assembly 118 is adjacent to polished bore receptacle 106 and packing assembly 124 is adjacent to polished bore receptacle 110 such that packing stacks 120, 126 seal respectively with polished bore receptacles 106, 110. Also in this position, flow control assembly 122 is adjacent to ported assembly 108. In this configuration, packing stacks 120, 126 provide fluid isolation for flow control assembly 122 and ported assembly 108.

In the illustrated embodiment, flow control assembly 122 of apparatus 100 is configured for fluid injection. For example, steam from a steam generator (not pictured) located at a surface flows through tubular string 102, depicted as arrows 128. A portion of the steam travels through flow control assembly 122 and ported assembly 108, depicted as arrows 130. The remaining portion of the steam continues to travel downwardly through tubular string 102, depicted as arrows 132, for injection by subsequent apparatuses 100 located farther downhole.

Figure 3:
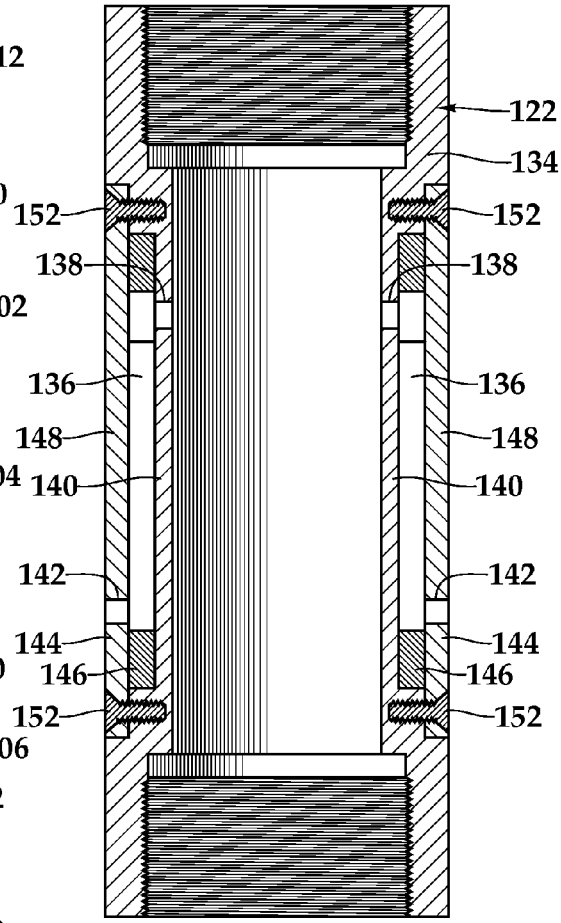
FIG. 3 is a cross sectional view of an apparatus for controlling the flow rate of a fluid during downhole operations according to an embodiment of the present invention.
Figure 4:
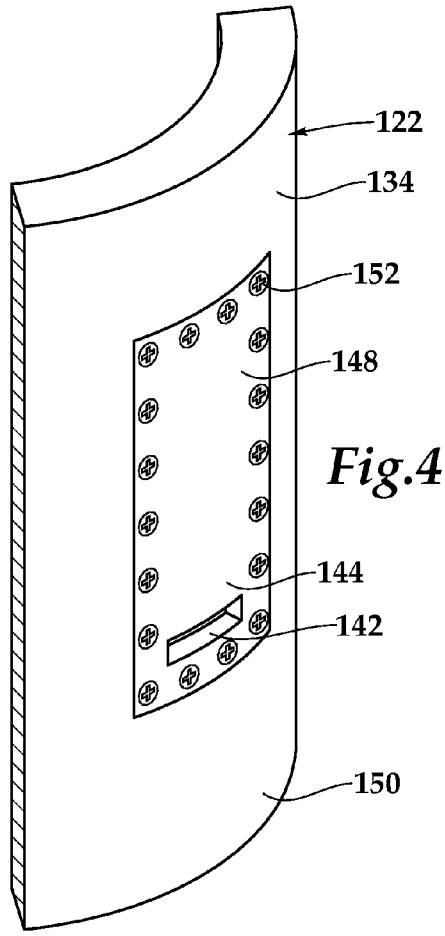
FIG. 4 is a side elevation of a 90 degree section of an apparatus for controlling the flow rate of a fluid during downhole operations according to an embodiment of the present invention.
Figure 5:
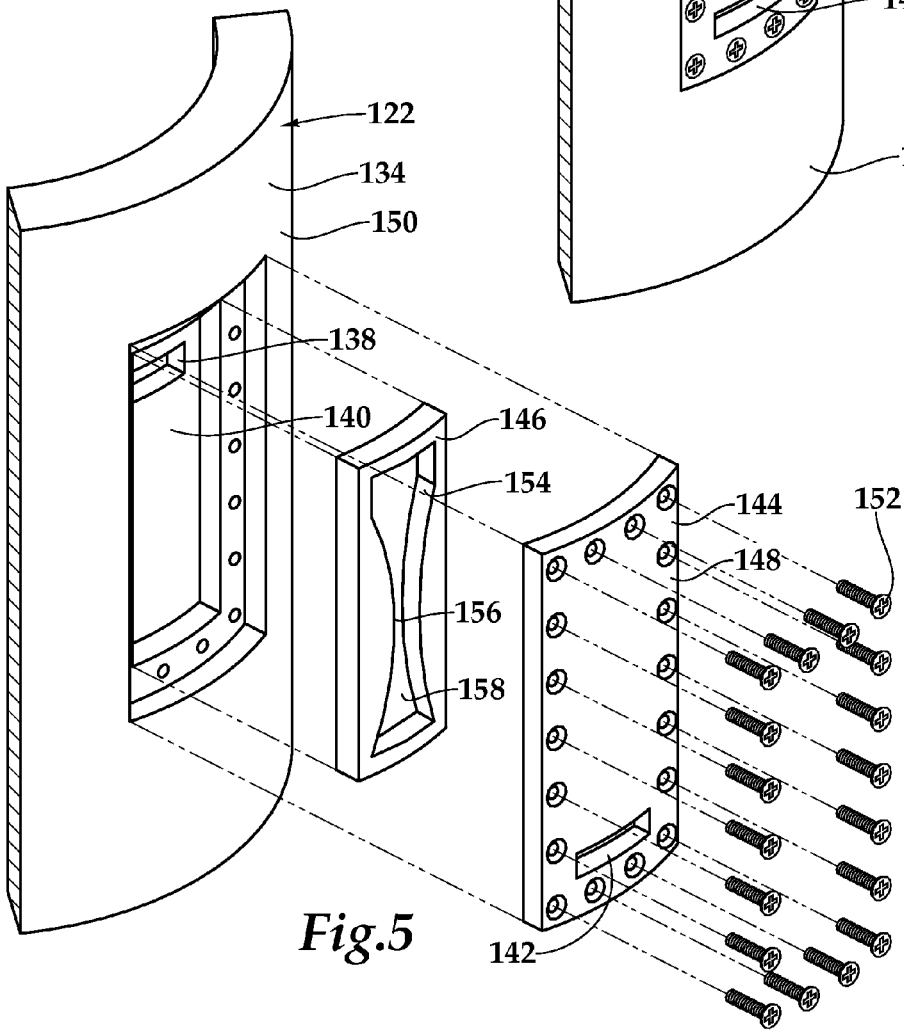
FIG. 5 is an exploded view of a 90 degree section of an apparatus for controlling the flow rate of a fluid during downhole operations according to an embodiment of the present invention.

As best seen FIGS. 3-5, flow control assembly 122 is formed from a generally tubular member 134 that has a pair of flow paths 136. Each flow path 136 includes an inlet 138 in an inner sidewall 140 and an outlet 142 in an outer sidewall 144 of tubular member 134. Each inlet 138 is laterally offset from its corresponding outlet 142 in the axial direction of tubular member 134. Fluidic devices 146 in the form of flat plates or curved plates (see FIG. 5), provide fluid communication from inlets 138 to outlets 142 to complete flow paths 136. Fluidic devices 146 are embedded within tubular member 134 between inner sidewall 140 and outer sidewall 144. Preferably, seals (not pictured) are located between fluidic devices 146 and inner sidewall 140 and outer sidewall 144 or around the perimeter of fluidic devices 146 to prevent leakage and assure that flow is directed through fluidic devices 146. In the illustrated embodiment, fluidic devices 146 are secured within tubular member 134 via a bolted connection of outer plates 148 onto a body portion 150 of tubular member 134 with a plurality of set screws 152. It should be understood by those skilled in the art, however, that fluidic devices 146 may be secured within tubular member 134 using other techniques without departing from the principles of the present invention including, but not limited to, welding, press fitting, epoxy, braising, investment casting, laser deposition and the like. In addition, even though fluidic devices 146 have be depicted as being a separate plate, those skilled in the art will understand that fluidic devices could alternatively be made integral with inner sidewall 140, outer sidewall 144 or both.

As best seen FIG. 5, each fluidic device 146 includes a nozzle 154 that has a throat portion 156 and diffuser portion 158. Use of a flat plate or curved plate venturi type nozzle provides for controlled steam injection at a critical flow of steam. Specifically, as the steam approaches throat portion 156 the velocity of the steam increases and the pressure of the steam decreases. In the throat portion 156 the steam reaches sonic velocity. In diffuser portion 158, the steam regains much of its lost pressure. The resulting critical flow rate is achievable using the fluidic device 146 in the flow control assembly 122 of the present invention over a broad annulus to tubing pressure ratio. For example, while conventional nozzles are able to produce a critical flow of steam at annulus to tubing pressure ratios up to about 0.6, using the fluidic device 146 in the flow control assembly 122 of the present invention, a critical flow of steam can be maintained at annulus to tubing pressure ratios up to about 0.9, thereby providing significant efficiency gains over prior art nozzles and systems.

The desired mass flow rate into a particular formation and into various formations may be achieved using flow control assemblies of the present invention. The mass flow rate through each flow control assembly may be determined through the selection of the appropriate fluidic devices 146. The size and design of throat portion 156 and diffuser portion 158 of a nozzle 154 as well as the number of fluidic devices 146 in a flow control assembly can be adjusted. For example, the use of nozzles 154 having smaller throat portions 156 will yield a reduced mass flow rate compared to the use of nozzles 154 having larger throat portions 156. Likewise, the use of more fluidic devices 146 in parallel will yield a larger mass flow rate. While the use of fewer fluidic devices 146 in parallel or inserting blank plates instead of fluidic devices 146 in certain locations of a flow control assembly will yield a smaller mass flow rate.

Figures 6A, 6B:
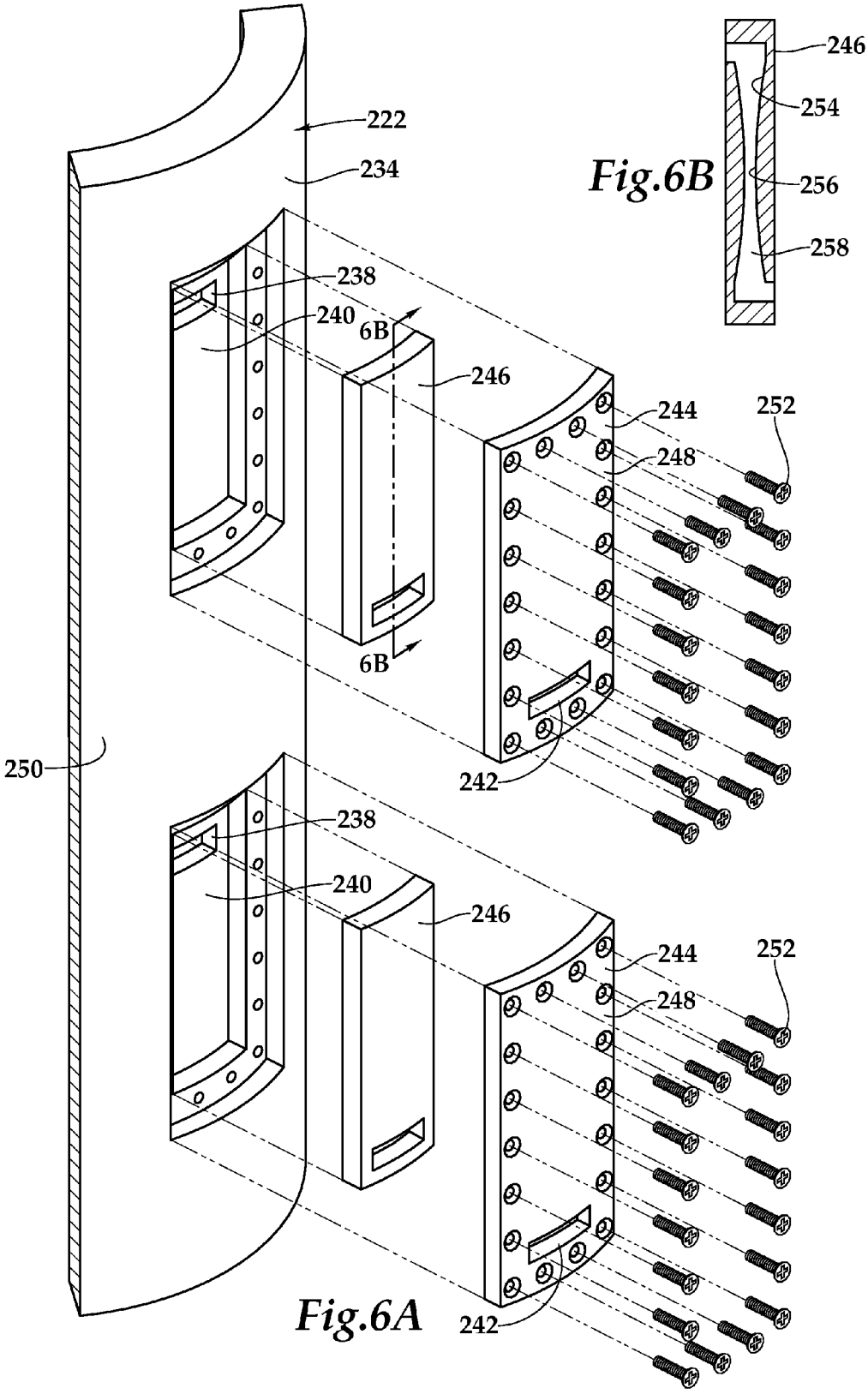
FIGS. 6A-6B are an exploded view of a 90 degree section of an apparatus for controlling the flow rate of a fluid during downhole operations and a cross sectional view of a fluidic device for an apparatus for controlling the flow rate of a fluid during downhole operations according to an embodiment of the present invention.

Even though the above embodiments of the apparatus for controlling the flow rate of a fluid during downhole operations of the present invention have been depicted as having multiple, independent fluidic devices that are circumferentially distributed at 180 degree intervals about the tubular member, it should be understood by those skilled in the art that the apparatuses of the present invention may have other configurations of fluidic devices without departing from the spirit of the present invention. For example, an apparatus of the present invention, may have other numbers of fluidic devices both greater than and less than two that are circumferentially distributed at uniform or irregular intervals about the tubular member including having a single fluidic devices extending substantially about the entire 360 degree circumference of the tubular member. As another example, as best seen in FIG. 6A, flow control assembly 222 is formed from a generally tubular member 234 (only a circumferential portion of which is shown) that has a pair of axially distributed flow paths. Each flow path includes an inlet 238 in an inner sidewall 240 and an outlet 242 in an outer sidewall 244 of tubular member 234. Each inlet 238 is laterally offset from its corresponding outlet 242 in the axial direction of tubular member 234. Fluidic devices 246 in the form of flat plates or curved plates, provide fluid communication from inlets 238 to outlets 242 to complete the flow paths. Fluidic devices 246 are embedded within tubular member 234 between inner sidewall 240 and outer sidewall 244 and are preferably secured within tubular member 234 via a bolted connection of outer plates 248 onto a body portion 250 of tubular member 234 with a plurality of set screws 252. In the illustrated embodiment, as best seen in FIG. 6B, fluidic devices 246 each include a nozzle 254 that has a throat portion 256 and diffuser portion 258 that are created by varying the depth or thickness of nozzle 254 rather than by varying the width of the nozzle as depicted above with reference to nozzle 154.

Figure 7:
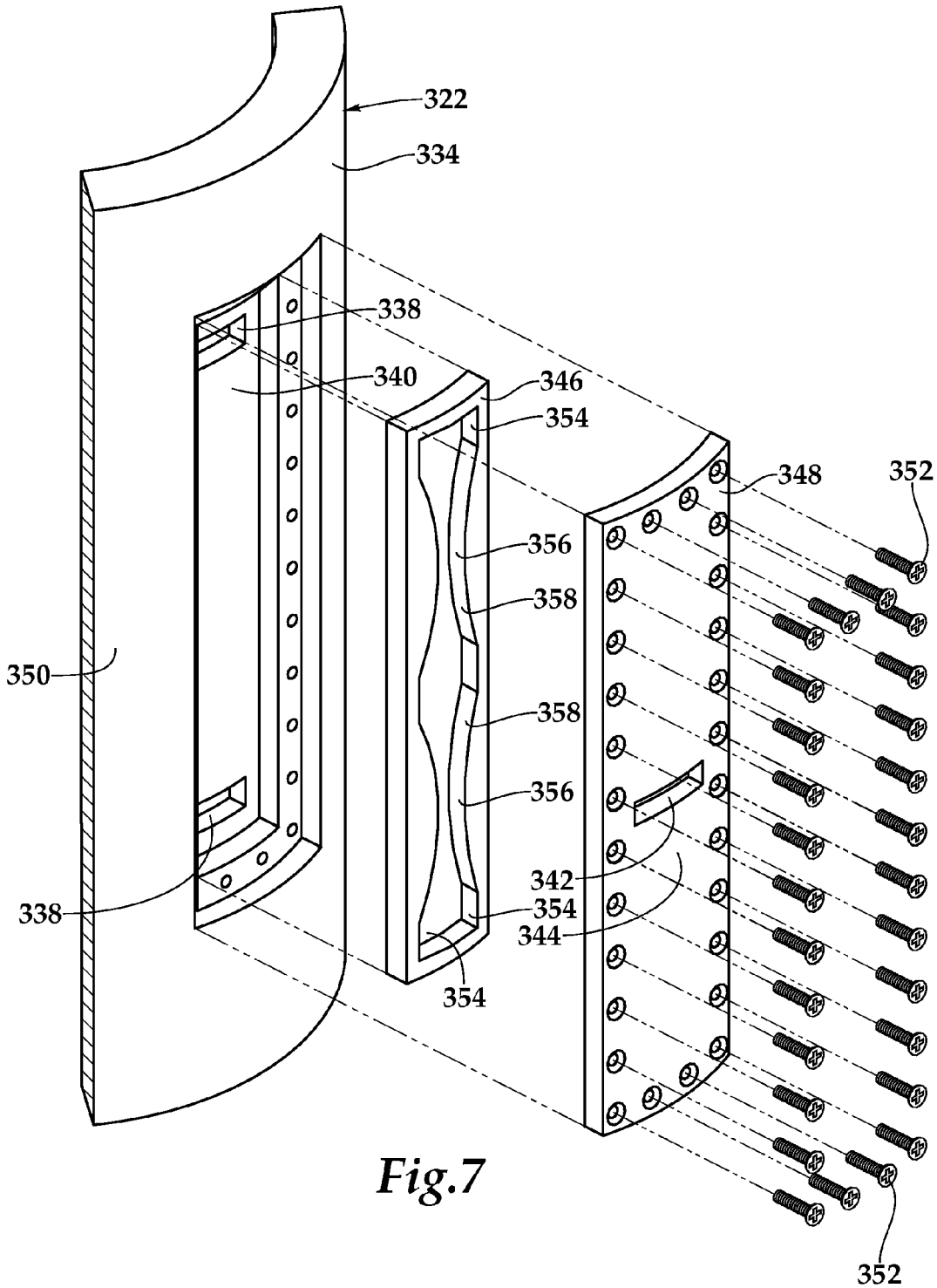
FIG. 7 is an exploded view of a 90 degree section of an apparatus for controlling the flow rate of a fluid during downhole operations according to an embodiment of the present invention.

Referring next to FIG. 7, therein is depicted another embodiment of an apparatus for controlling the flow rate of a fluid during downhole operations of the present invention. Flow control assembly 322 is formed from a generally tubular member 334 (only a circumferential portion of which is shown) that has a pair of axially distributed flow paths. Each flow path includes an inlet 338 in an inner sidewall 340. The two flow paths, however, share a common outlet 342 in an outer sidewall 344 of tubular member 334. Each inlet 338 is laterally offset from outlet 342 in the axial direction of tubular member 334. A fluidic device 346 in the form of a flat plate or a curved plate, provides fluid communication from inlets 338 to outlet 342 to complete the flow paths. Fluidic device 346 is embedded within tubular member 334 between inner sidewall 340 and outer sidewall 344 and is preferably secured within tubular member 334 via a bolted connection of outer plate 348 onto a body portion 350 of tubular member 334 with a plurality of set screws 352. Preferably, fluidic device 346 includes a pair of nozzles 354 each having a throat portion 356 and diffuser portion 358.

Figure 8:
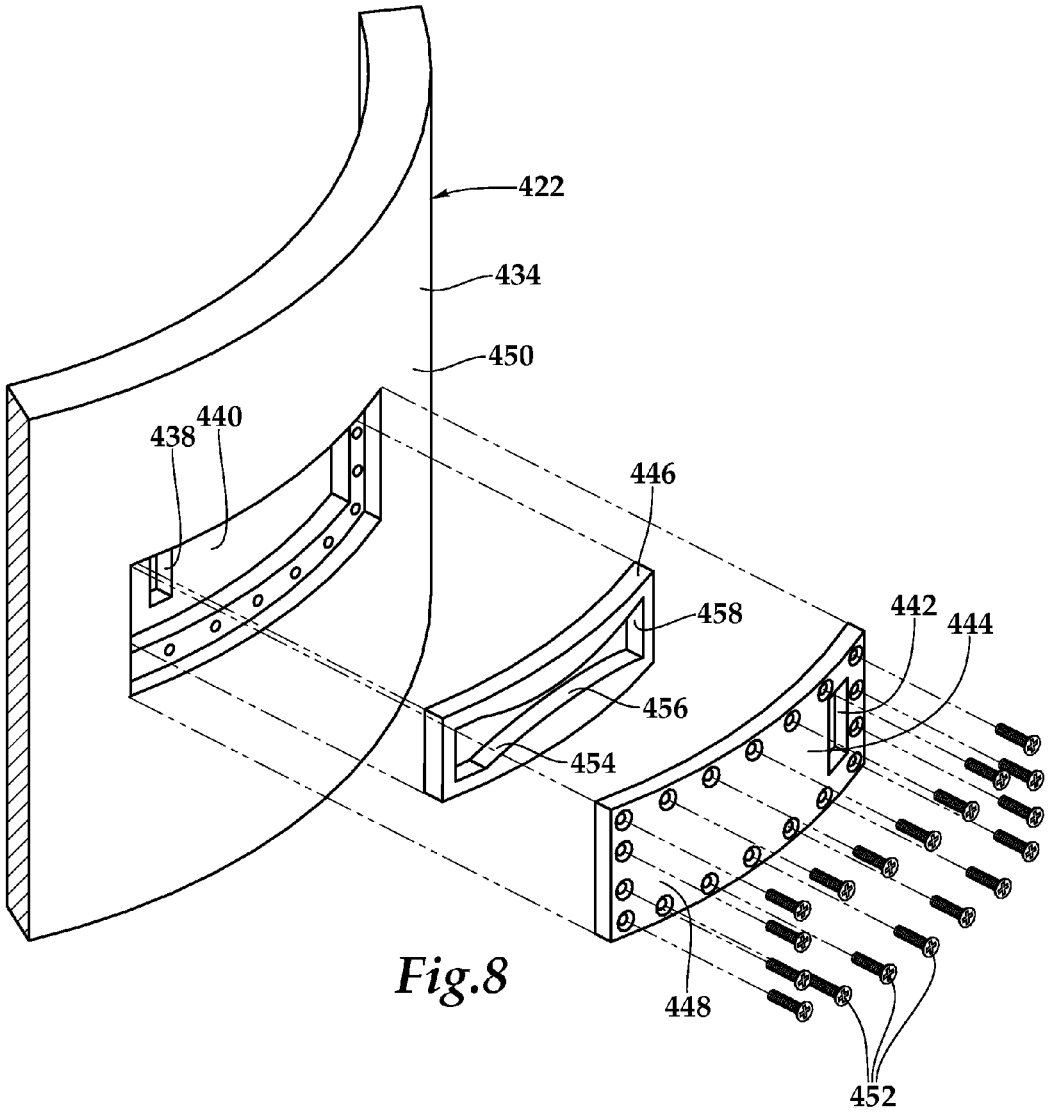
FIG. 8 is an exploded view of a 90 degree section of an apparatus for controlling the flow rate of a fluid during downhole operations according to an embodiment of the present invention.

Referring next to FIG. 8, therein is depicted another embodiment of an apparatus for controlling the flow rate of a fluid during downhole operations of the present invention. Flow control assembly 422 is formed from a generally tubular member 434 (only a circumferential portion of which is shown). As illustrated, tubular member 434 has a flow path that includes an inlet 438 in an inner sidewall 440 and an outlet 442 in an outer sidewall 444 of tubular member 434. Inlet 438 is laterally offset from outlet 442 in the circumferentially direction of tubular member 434. A fluidic device 446 in the form of a curved plate, provides fluid communication from inlet 438 to outlet 442 to complete the flow path. Fluidic device 446 is embedded within tubular member 434 between inner sidewall 440 and outer sidewall 444 and is preferably secured within tubular member 434 via a bolted connection of outer plate 448 onto a body portion 450 of tubular member 434 with a plurality of set screws 452. Preferably, fluidic device 446 includes a nozzle 454 having a throat portion 456 and diffuser portion 458.

Figure 9:
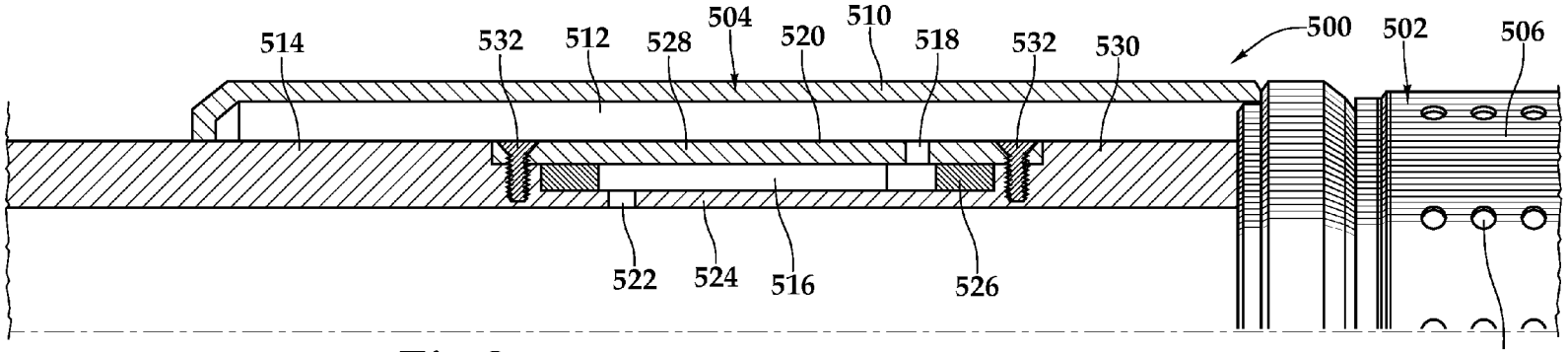
FIG. 9 is side view partially in quarter section of a fluid flow control device including an apparatus for controlling the flow rate of a fluid during downhole operations according to an embodiment of the present invention.
Figure 10:
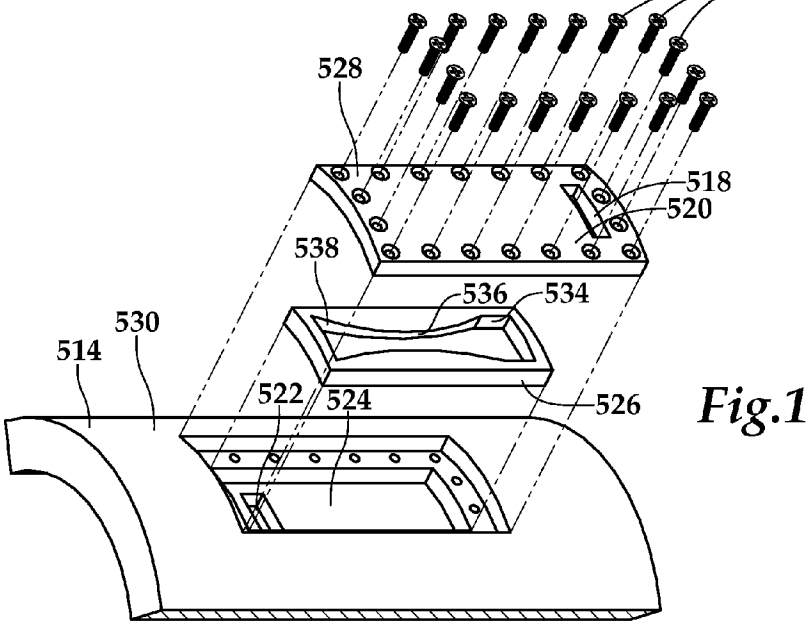
FIG. 10 is an exploded view of a 90 degree section of an apparatus for controlling the flow rate of a fluid during downhole operations according to an embodiment of the present invention.

In addition to controlling the injection rate of a fluid such as steam into one or more zones of a wellbore, the apparatus for controlling the flow rate of a fluid during downhole operations of the present invention may also be used to control the inflow of production fluids. For example and referring to FIGS. 9-10, therein is depicted a fluid flow control device according to the present invention that is representatively illustrated and generally designated 500. Fluid flow control device 500 may be suitably coupled to other similar fluid flow control devices, seal assemblies, production tubulars or other downhole tools to form a tubing string. Fluid flow control device 500 includes a sand control screen section 502 and a flow restrictor section 504. Sand control screen section 502 includes a suitable sand control screen element or filter medium, such as a wire wrap screen, a woven wire mesh screen or the like, designed to allow fluids to flow therethrough but prevent particulate matter of sufficient size from flowing therethrough. In the illustrated embodiment, a protective outer shroud 506 having a plurality of perforations 508 is positioned around the exterior of the filter medium.

Flow restrictor section 504 is configured in series with sand control screen section 502 such that fluid must pass through sand control screen section 502 prior to entering flow restrictor section 504. Flow restrictor section 504 includes an outer housing 510. Outer housing 510 defines an annular chamber 512 with base pipe 514. Base pipe 514 includes at least one flow path 516. Flow path 516 includes an inlet 518 in an outer sidewall 520 and an outlet 522 in an inner sidewall 524 of base pipe 514. Inlet 518 is laterally offset from outlet 522 in the axial direction of base pipe 514. A fluidic device 526 in the form of a flat plate or curved plate, provides fluid communication from inlet 518 to outlet 522 to complete flow path 516. Fluidic device 526 is embedded within base pipe 514 between inner sidewall 524 and outer sidewall 520 and is preferably secured within base pipe 514 via a bolted connection of outer plate 528 onto a body portion 530 of base pipe 514 with a plurality of set screws 532. Preferably, fluidic device 526 includes a nozzle 534 having a throat portion 536 and diffuser portion 538.

Figure 11:
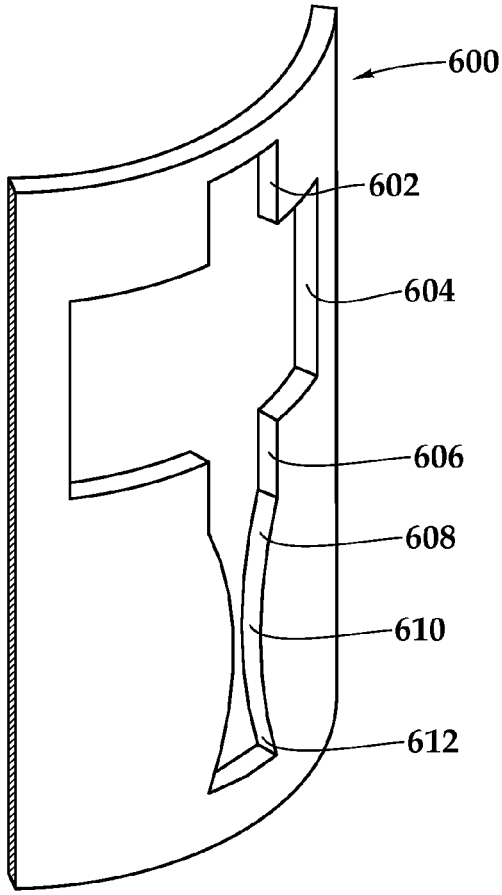
FIG. 11 is a side elevation of a two stage fluidic device plate for use in an apparatus for controlling the flow rate of a fluid during downhole operations according to an embodiment of the present invention.

Referring next to FIG. 11, therein is depicted a two stage fluidic device plate for use in an apparatus for controlling the flow rate of a fluid during downhole operations that is generally designated 600. Fluidic device 600 may be used to replace any of the above described fluidic devices when it is desired to dampen upstream pressure differences and ensure substantially constant pressure entering the nozzle. Specifically, fluidic device 600 includes an intake region 602, a pressure dampening chamber 604, a transition region 606 and a nozzle 608 including a throat portion 610 and a diffuser portion 612.

Figure 12:
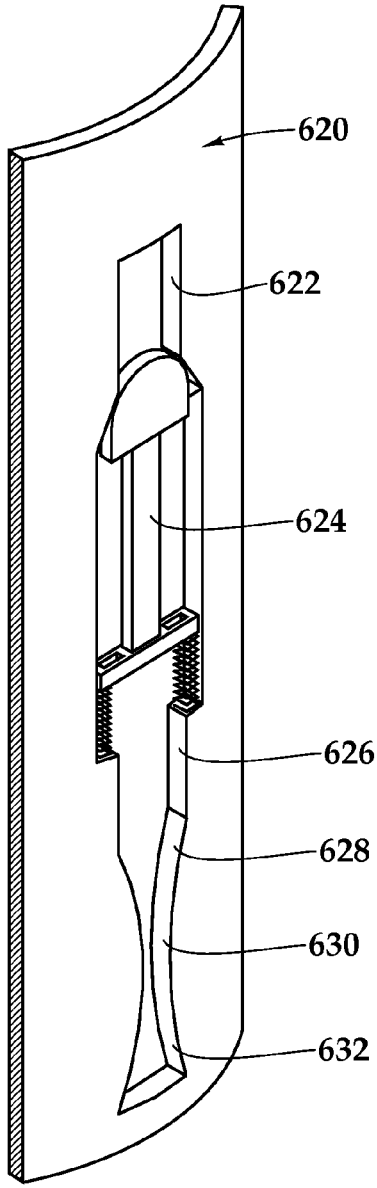
FIG. 12 is a side elevation of a two stage fluidic device plate for use in an apparatus for controlling the flow rate of a fluid during downhole operations according to an embodiment of the present invention.

Referring next to FIG. 12, therein is depicted a two stage fluidic device plate for use in an apparatus for controlling the flow rate of a fluid during downhole operations that is generally designated 620. Fluidic device 620 may be used to replace any of the above described fluidic devices when it is desired to allow only one-way flow through the nozzle. Specifically, fluidic device 620 includes an intake region 622, a one-way valve assembly 624, a transition region 626 and a nozzle 628 including a throat portion 630 and a diffuser portion 632.

Figure 13:
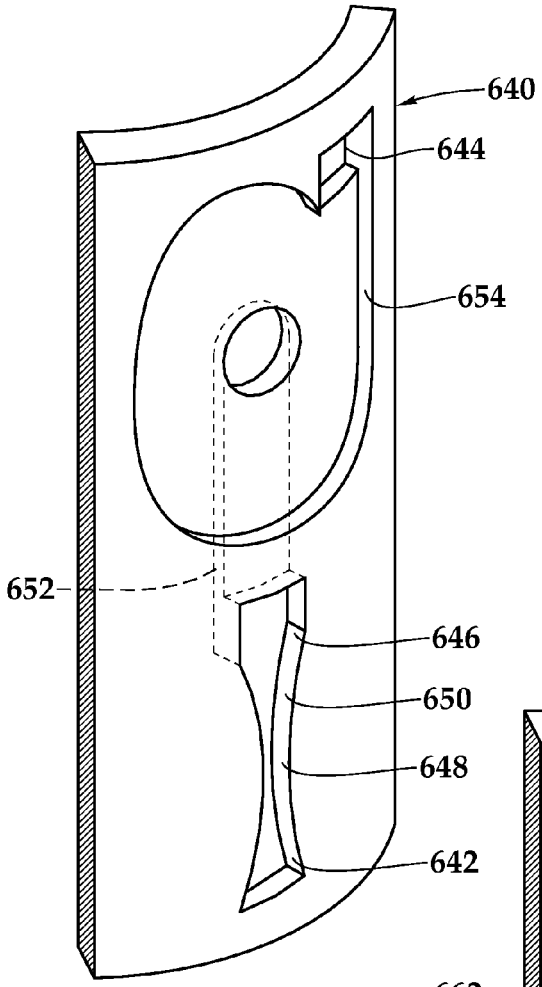
FIG. 13 is a side elevation of a two stage fluidic device plate for use in an apparatus for controlling the flow rate of a fluid during downhole operations according to an embodiment of the present invention.
Figure 14:
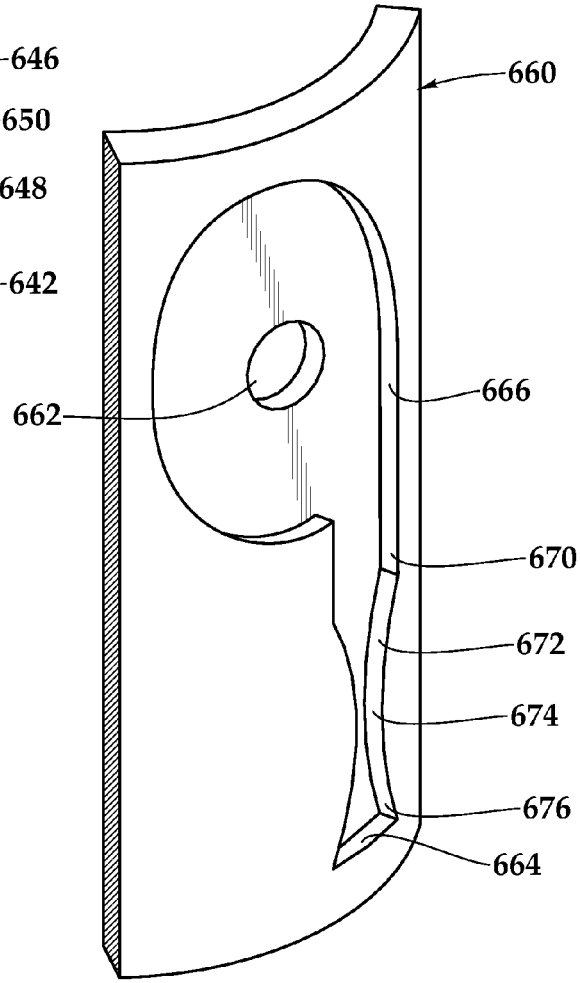
FIG. 14 is a side elevation of a two stage fluidic device plate for use in an apparatus for controlling the flow rate of a fluid during downhole operations according to an embodiment of the present invention.

Referring next to FIGS. 13-14, therein are depicted a pair of two stage fluidic device plates for use in an apparatus for controlling the flow rate of a fluid during downhole operations that are generally designated 640 and 660. Fluidic devices 640 and 660 may be used to replace any of the above described fluidic devices when it is desired to create preferential flow directionality through the nozzle. Specifically, fluidic device 640 creates a preferential flow direction for fluid to travel from intake area 642 to outlet 644. Fluid entering nozzle 646 at intake area 642 travels through throat portion 648 and diffuser portion 650 then enters passageway 652 and is discharged into chamber 654. Once in chamber 654 the fluid exits fluidic device 640 with little additional pressure drop through outlet 644. In cases of reverse flow, however, when fluid enters fluidic device 640 at outlet 644, due to the swirling effect within chamber 654, significant pressure drop occurs within chamber 654 before the fluid enters nozzle 646 via passageway 652.

Similarly, fluidic device 660 creates a preferential flow direction for fluid to travel from inlet 662 to exit area 664. Fluid enters chamber 666 from inlet 662 and travels with little additional pressure drop to transition area 670 and into nozzle 672 including throat portion 674 and diffuser portion 676. In cases of reverse flow, however, when fluid enters fluidic device 660 at exit area 664, it travels through nozzle 672 and transition area 670 into chamber 666. Due to the swirling effect within chamber 666, significant pressure drop occurs within chamber 666 before the fluid exits fluidic device 660 via inlet 662. In certain embodiments, fluidic devices 640 and 660 may be installed in the same apparatus, for example in parallel with one another, so that the apparatus may be used for both injection and production operations, wherein preferential flow directionality changes based upon the desired operation.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for controlling the flow rate of a fluid during downhole operations, the apparatus comprising:

a tubular member having a flow path between inner and outer portions of the tubular member, the flow path including an inlet and an outlet that are laterally offset from each other; and a fluidic device positioned in the flow path between the inlet and the outlet, the fluidic device comprising a plate member embedded within the tubular member between inner and outer sidewalls of the tubular member, whereby the fluidic device is operable to control the flow rate of the fluid through the flow path.

2. The apparatus as recited in claim 1 wherein the inlet is in the inner sidewall of the tubular member and the outlet is in the outer sidewall of the tubular member.

3. The apparatus as recited in claim 1 wherein the inlet is in the outer sidewall of the tubular member and the outlet is in the inner sidewall of the tubular member.

4. The apparatus as recited in claim 1 wherein the inlet and the outlet are laterally offset from each other in the axial direction of the tubular member.

5. The apparatus as recited in claim 1 wherein the inlet and the outlet are laterally offset from each other in the circumferential direction of the tubular member.

6. The apparatus as recited in claim 1 wherein the fluidic device further comprises a curved plate member positioned between the inner sidewall and the outer sidewall of the tubular member.

7. The apparatus as recited in claim 1 wherein the fluidic device further comprises a nozzle having a throat portion and a diffuser portion, whereby the fluid will flow through the nozzle at a critical flow rate.

8. The apparatus as recited in claim 1 wherein the fluidic device further comprises a two stage fluidic device wherein one of the stages includes a nozzle having a throat portion and a diffuser portion, whereby the fluid will flow through the nozzle at a critical flow rate.

9. The apparatus as recited in claim 1 wherein the flow path includes first and second inlets, wherein the fluidic device further comprises a pair of nozzles each having a throat portion and a diffuser portion, whereby the fluid will flow through the nozzles at a critical flow rate and wherein the nozzles share the outlet.

10. An apparatus for controlling the flow rate of fluid injected into a downhole formation, the apparatus comprising:

a tubular member having a flow path between inner and outer portions of the tubular member, the flow path including an inlet in an inner sidewall of the tubular member and an outlet in an outer sidewall of the tubular member, the inlet and the outlet laterally offset from each other; and a fluidic device positioned in the flow path between the inlet and the outlet, the fluidic device comprising a plate member embedded within the tubular member between the inner sidewall and the outer sidewall, the fluidic device including a nozzle having a throat portion and a diffuser portion, whereby the fluid will flow through the nozzle at a critical flow rate.

11. The apparatus as recited in claim 10 further comprising a latching assembly coupled to the tubular member, the latching assembly operable to establish a secure relationship between the apparatus and a downhole tubular string into which the apparatus is inserted.

12. The apparatus as recited in claim 10 further comprising a pair of packing assemblies positioned on opposites sides of the tubular member, the packing assemblies operable to establish a sealing relationship between the apparatus and a downhole tubular string into which the apparatus is inserted, the packing assemblies providing isolation such that fluid discharged from the outlet is in fluid communication with at least one opening of the downhole tubular string.

13. The apparatus as recited in claim 10 wherein the fluidic device further comprises a curved plate member positioned between the inner sidewall and the outer sidewall of the tubular member.

14. The apparatus as recited in claim 10 wherein the fluidic device further comprises a two stage fluidic device.

15. The apparatus as recited in claim 10 wherein the flow path includes first and second inlets, wherein the fluidic device further comprises a pair of nozzles each having a throat portion and a diffuser portion, whereby the fluid will flow through the nozzles at a critical flow rate and wherein the nozzles share the outlet.

16. A flow control apparatus for controlling the inflow of production fluids from a subterranean well, the flow control apparatus comprising:

a tubular member having a flow path between outer and inner portions of the tubular member, the flow path including an inlet in an outer sidewall of the tubular member and an outlet in an inner sidewall of the tubular member, the inlet and the outlet laterally offset from each other; and a fluidic device positioned in the flow path between the inlet and the outlet, the fluidic device comprising a plate member embedded within the tubular member between the inner sidewall and the outer sidewall, the fluidic device including a nozzle having a throat portion and a diffuser portion, whereby the production fluids will flow through the nozzle at a critical flow rate.

17. The apparatus as recited in claim 16 wherein the fluidic device further comprises a curved plate member positioned between the inner sidewall and the outer sidewall of the tubular member.

* * * * *